US005226180A

United States Patent [19]

Leach

[11] Patent Number: 5,226,180

[45] Date of Patent: Jul. 13, 1993

[54] PROTECTIVE CAP FOR GOLFERS

[76] Inventor: Robert E. Leach, 4115 NE. 143 Ave., Vancouver, Wash. 98682

[21] Appl. No.: 801,265

[22] Filed: Dec. 2, 1991

[51] Int. Cl.[5] ..... A42B 3/06

[52] U.S. Cl. ..... 2/411; 2/171.1; 2/181.2; 2/182.6; 2/195; 2/425

[58] Field of Search ..... 2/7, 171, 181, 181.4, 2/182.1, 182.2, 209.3, 209.7, 410, 411, 425, DIG. 1, 171.1, 181.2, 181.6, 182.6, 182.8, 185 B, 185 C, 185 R, 196, 199, 209.1, 414

[56] References Cited

U.S. PATENT DOCUMENTS

| | | | |
|---|---|---|---|
| 1,187,507 | 6/1916 | Coyne | 2/182.6 |
| 1,347,046 | 7/1920 | McDonough | 2/410 |
| 1,789,188 | 1/1931 | McGuigan | 2/185 |
| 2,218,947 | 10/1940 | Brunzell | 2/195 |
| 2,333,987 | 11/1943 | Dandy | 2/425 |
| 2,794,189 | 6/1957 | Nesbit | 2/195 |
| 4,114,201 | 9/1978 | Garrison | 2/209.7 |
| 4,131,953 | 1/1979 | Kimotsuki | 2/171.1 |
| 4,443,891 | 4/1984 | Blomgren | 2/425 |
| 4,558,470 | 12/1985 | Mitchell | 2/414 |
| 4,630,317 | 12/1986 | Brown | 2/199 |
| 4,903,348 | 2/1990 | Broersma | 2/425 |
| 5,088,130 | 2/1992 | Chiarella | 2/411 |
| 5,101,516 | 4/1992 | Scarnato | 2/181 |

FOREIGN PATENT DOCUMENTS

| | | | |
|---|---|---|---|
| 217996 | 4/1987 | European Pat. Off. | 2/411 |
| 884067 | 7/1953 | Fed. Rep. of Germany | 2/181.2 |

*Primary Examiner*—Clifford D. Crowder
*Assistant Examiner*—Diana L. Biefeld
*Attorney, Agent, or Firm*—James D. Givnan, Jr.

[57] ABSTRACT

A protective piece of headgear including an outer cover of conventional appearance in place about and concealing an impact absorbing shell of STYROFOAM or the like. Elongate openings in the shell serve to ventilate the shell and are shaped and sized to prevent golf ball contact with the upper part of the wearer's head. Interchangeable adhesive spacer elements permit the shell to be sized to a wearer's head. Retention of the cover on the shell, either permanently or temporarily, is by a suitable adhesive.

5 Claims, 1 Drawing Sheet

PROTECTIVE CAP FOR GOLFERS

BACKGROUND OF THE INVENTION

The present invention pertains generally to protective head wear for wear by those participating in sports.

A risk is assumed by golfers in that they are subject to being hit by an errant golf ball. While protective helmets exist for wear by those involved in football and baseball and various other head gear for other sports are available, wear by golfers of any protective gear has not been adopted for one or more reasons such as, for example, appearance and/or comfort.

Examples of protective caps can be found in U.S. Pat. Nos. 2,333,987; 2,794,189 and 2,218,947.

SUMMARY OF THE PRESENT INVENTION

The present invention is embodied in a hat having a protective liner of ventilated, lightweight construction for concealment within an outer fabric member of more or less conventional appearance.

A protective shell or liner is of generally hemispherical shape having a myriad of openings spaced thereabout to permit a ventilating airflow through the shell. The openings are of a size and shape to prevent penetration of a golf ball into contact with the wearer's head. The interior of the shell is provided with spacers of a range of selected thicknesses to accommodate a range of head sizes as well as to assure retention of the hat on a wearer's head. Preferably the spacers may be of the type with an adhesive backing permitting selection of a spacer or spacers of a desired thickness. An outer member of the present headpiece may be of conventional appearance, as for example, a cap having a bill with the outer member affixed at spaced apart points to the shell.

Important objectives include the provision of a lightweight protective cap suitable for inconspicuous wear on a golf course; the provision of a protective cap having a multitude of relatively large openings for purposes of ventilation without being susceptible to golf ball penetration; the provision of a protective cap with spacers which are of a interchangeable type for different head sizes; the provision of a headpiece wherein an outer cover is loosely affixed in place on a protective shell.

DETAILED DESCRIPTION OF THE PREFERRED EMBODIMENT

Figure 1:
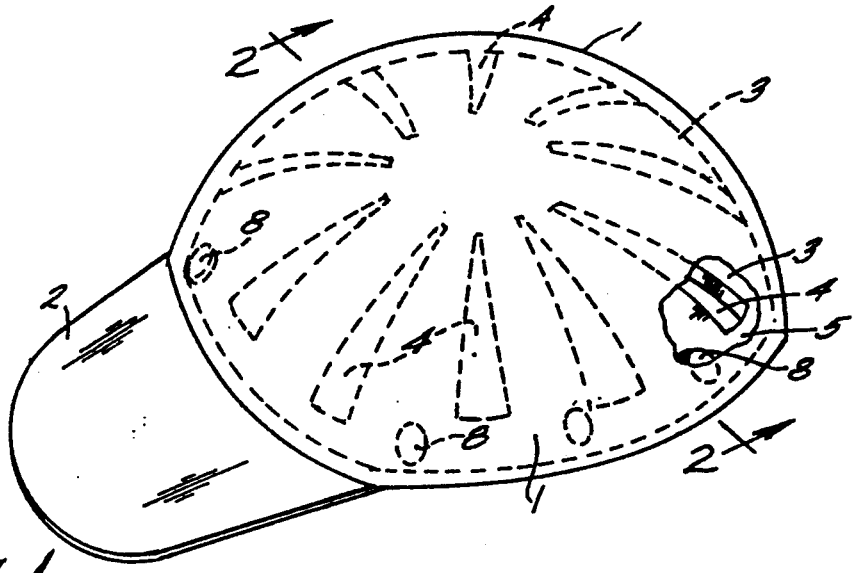
FIG. 1 is a perspective view of one form of the present headpiece.
Figure 2:
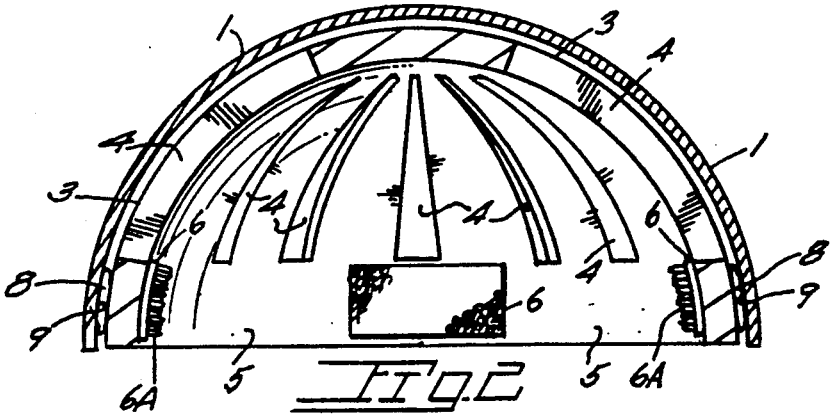
FIG. 2 is a vertical sectional view taken along line 2—2 of FIG. 1.
Figure 3:
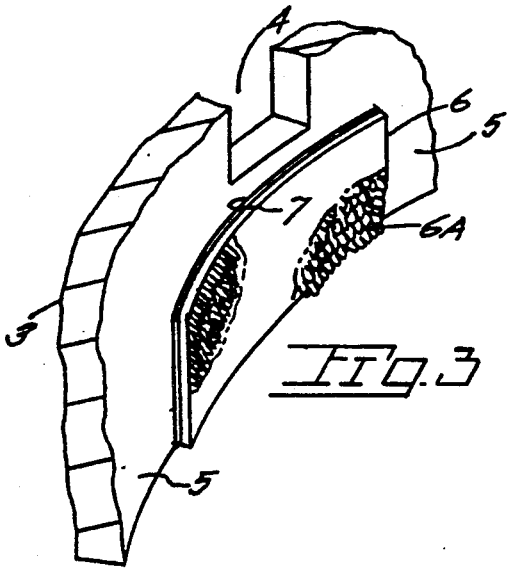
FIG. 3 is a fragmentary perspective view of a shell with a spacer affixed in place.

With continuing attention to the drawings wherein applied reference numerals indicate parts similarly hereinafter identified, the reference numeral 1 indicates the outer or cover member of a headpiece for wear by those participating in the game of golf or any other endeavor where the person is at risk from a ball or other moving object.

Cover 1 is preferably of a fabric and having the appearance of a conventional ball cap having a bill 2 or other piece of headgear.

A shell 3 is of somewhat hemispherical shape and preferably constructed from a foamed material such as STYROFOAM. Spaced about the shell are a multitude of openings 4 which while shown as being triangular ma be otherwise shaped. In those pieces of headgear for wear by golfers, the openings 4 will have at least one dimension (presently width) substantially less than the diameter of a golf ball to prevent ball penetration into the openings to the extent contact could occur with the wearer's skull.

The openings 4 serve to permit a ventilating airflow into and out of the shell interior and, secondly, effect a weight reduction of the shell without jeopardizing the protective capability of the shell.

A lower marginal internal surface 5 extends about the interior of the shell and serves to receive spacer elements 6 which ar affixed to the shell by an adhesive layer 7 of the elements applied to the spacer during spacer manufacture. One suitable spacer is that type of fabric closure strip commonly used in conjunction with a companion strip to effect separable attachment of two articles. As the loop patch of the fabric closure strips is manufactured with different pile depths such may be utilized to provide a set of spacers each of a thickness to provide the wearer with spacer elements to best suit the head size. A loop pile is at 6A.

Outer cover 1 is generally of a size and hemispherical shape so as to correspond to the exterior configuration of the shell. Attachment of the cove to the shell is by the application of retention means such as a quantity of an adhesive 8 deposited at points about the lower outer area of the shell. Other retention means may be utilized if desired depending to some extent whether the cover is to be permanently attached or removably attached. For example, a coating of rubber cement about the lower outer area of the shell and also about the corresponding portion 9 of the cover would permit intentional removal of cover 1. The use of a suitable adhesive with the fabric cover and STYROFOAM (or other material) shell could provide permanent attachment if so desired.

While the protective cap above described is set forth as being for wear by golfers, it will be understood that the headpiece is suitable for use by anyone encountering the risk of contact with a ball or other potentially injurious article. Similarly, while a cap with a bill is disclosed in the drawings and description, it will be understood that cover 1 may take many forms to permit the present invention to be incorporated in various styles and types of headgear to suit the user.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

1. A protective headpiece comprising, a shell of rigid foamed material and of generally hemispherical shape, a multitude of ventilation openings defined by the shell and spaced apart about the shell, a fabric cover disposed about and generally corresponding to the shell exterior to conceal same when the headpiece is worm, fabric spacer elements with a pile depth including an adhesive surface and removably attached in place on the interior of the shell and including a resilient pile for contact with the wearer's head, and, adhesive retention means on the shell exterior and adhering to said fabric cover to retain the latter in place on the shell.

2. The protective headpiece claimed in claim 1 wherein said openings are elongate and circumferentially spaced in a uniform manner about the shell.

3. The protective headpiece claimed in claim 1 wherein said shell has continuous lower inner and outer marginal areas on which said spacer elements and said adhesive retention means are carried.

4. The protective headpiece claimed in claim 3 wherein said adhesive retention means adheres to the lower extremities of said shell and said cover and is separable from at least one of said extremities to permit removal of the cover.

5. The protective headpiece claimed in claim 1 for wear by golfers and wherein said openings defined by the shell are of generally triangular shape with at least one dimension of each of said openings less than that of golf ball diameter.

* * * * *